US006050104A

United States Patent [19]

Corona

[11] Patent Number: 6,050,104

[45] Date of Patent: Apr. 18, 2000

[54] CHILLING AND/OR STORING RECEPTACLE FOR BOTTLES OR BEVERAGE CONTAINERS

[76] Inventor: Gary L. Corona, 7027 Hunters Glen, Dallas, Tex. 75205

[21] Appl. No.: 09/112,370

[22] Filed: Jul. 9, 1998

Related U.S. Application Data

[60] Provisional application No. 60/053,421, Jul. 22, 1997.

[51] Int. Cl.[7] ..... F25D 3/08

[52] U.S. Cl. ..... 62/457.4; 62/457.5; 62/457.9; 62/421; 220/592.01; 220/592.02

[58] Field of Search ..... 62/457.4, 457.5, 62/457.9, 421; 220/592.01, 592.02

[56] References Cited

U.S. PATENT DOCUMENTS

| | | | |
|---|---|---|---|
| 3,734,439 | 5/1973 | Wintiz | 248/224 |
| 3,863,563 | 2/1975 | Popeil | 100/102 |
| 4,300,697 | 11/1981 | Dickens | 220/19 |
| 4,338,795 | 7/1982 | House, Jr. | 62/372 |
| 4,629,153 | 12/1986 | Marcum | 248/558 |
| 4,883,169 | 11/1989 | Flanagan, Jr. | 206/170 |
| 5,005,374 | 4/1991 | Spitler | 62/259.3 |
| 5,147,079 | 9/1992 | Heather | 224/148 |
| 5,269,156 | 12/1993 | Van De Velde et al. | 62/457.4 |

*Primary Examiner*—Henry Bennett
*Assistant Examiner*—Mark Shulman
*Attorney, Agent, or Firm*—Jackson Walker, LLP

[57] ABSTRACT

A cylinder shaped receptacle with one open end to receive bottles or beverage containers and is utilized in an ice bin, ice maker, freezer, or any refrigerated placement area to chill, refrigerate or store open, partially used or unused bottles, such as wine or liquor, or any other beverage container that is best when served cold or should be preserved cold. The receptacle has an adjustable, permanent support stand with rubber footings on the base to prevent movement. This movement, if any, is most likely to occur on a refrigeration shelf. For commercial usage the receptacle is manufactured without the support stand and can be suspended in the ice bin by utilizing a receptacle suspension clip.

The receptacle can be utilized in a vertical, horizontal or slanted position. The adjustable support stand enables the user to obtain a variable slanted position by loosening the two wing nuts on the support stand, positioning the stand to the desired angle and then retightening the two wing nuts. When utilizing the receptacle in a residential wet bar ice maker, a specially designed rubber receptacle lid or cap with numerous slits to permit ultimate pliability should be placed on the open end of the receptacle in order to prevent ice cubes from dropping into the cylinder. This rubber lid is produced from an extremely pliable material in order to permit the bottle or container to easily slide in and out of the receptacle opening. The receptacle itself contains slots or openings small enough to prevent ice cubes or ice chunks from entering the chilling or storing area.

The receptacles may also be manufactured permanently clustered together for users requiring serving volume or beverage selection. For more flexible uses the receptacles may be clustered together by utilizing receptacle connector clamps.

14 Claims, 2 Drawing Sheets

FIG. 1
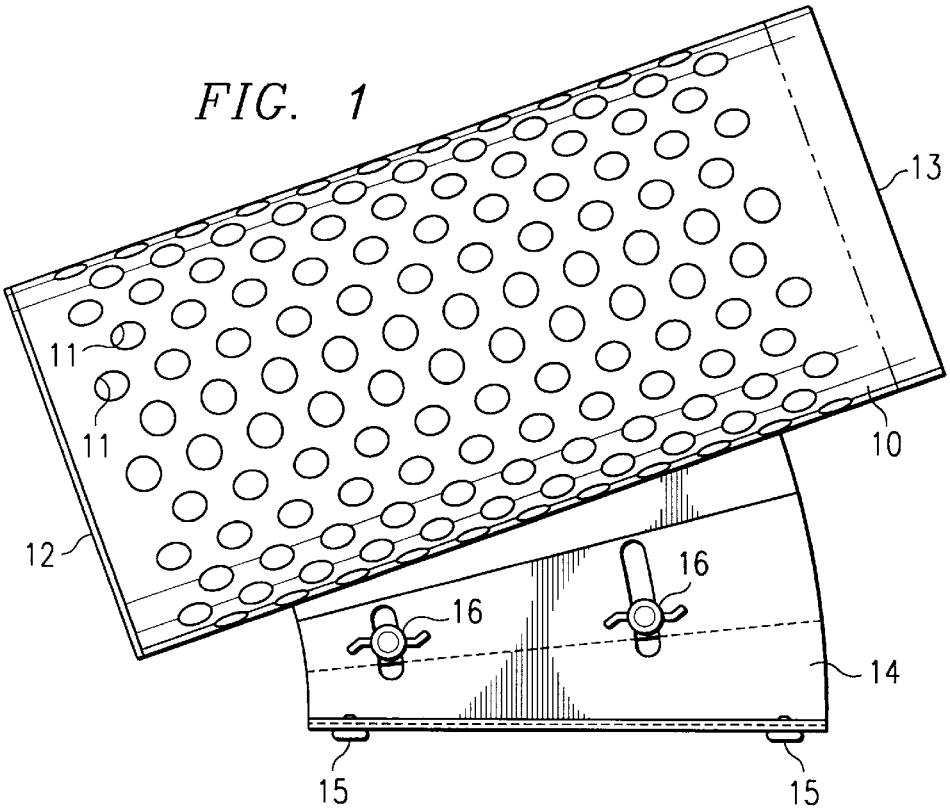
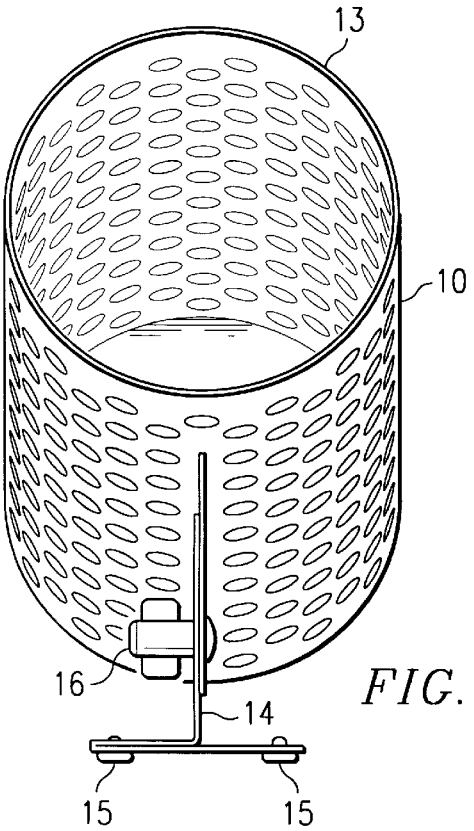
FIG. 2
FIG. 3
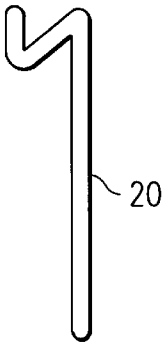

FIG. 4
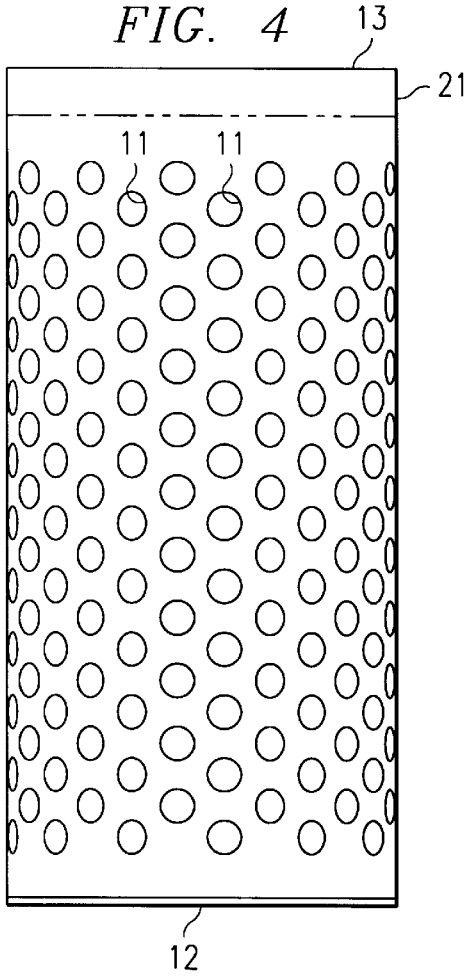
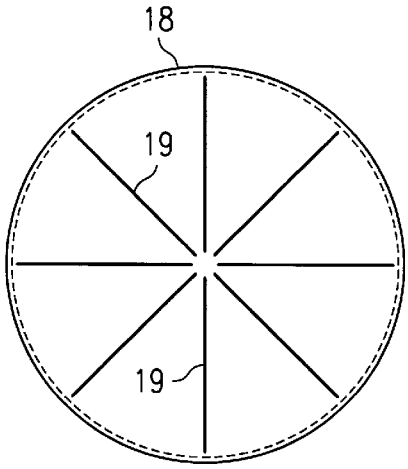
FIG. 6
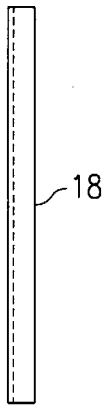
FIG. 6A
FIG. 5
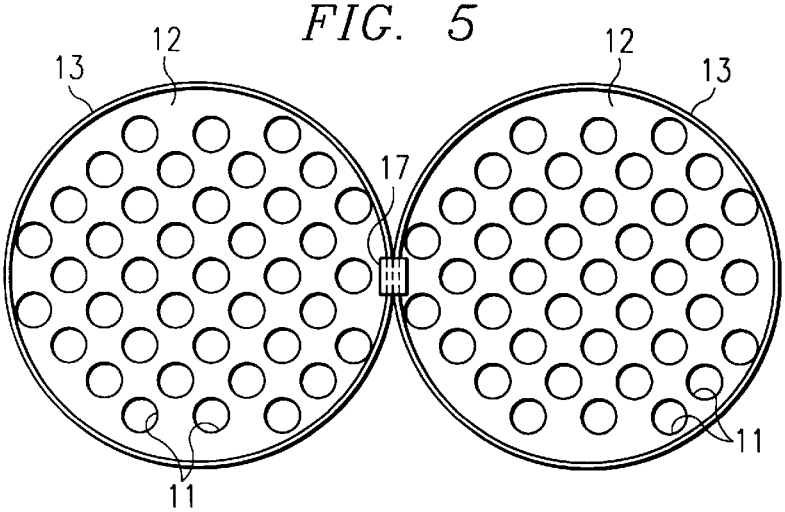
FIG. 5A
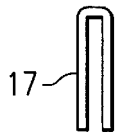

CHILLING AND/OR STORING RECEPTACLE FOR BOTTLES OR BEVERAGE CONTAINERS

This application claims benefit of Provisional Appl. 60/053,421 filed Jul. 22, 1997.

BACKGROUND OF THE INVENTION

This invention provides a means of efficiently, sanitarily and conveniently chilling, refrigerating or storing bottles or beverage containers that are best when stored or served cold. The conventional placement method to either chill, refrigerate or store bottles or beverage containers is to place the bottle or beverage container itself, directly in the refrigerator or an ice maker or ice bin.

The method of placing a bottle or beverage container in a residential ice maker or commercial ice bin is usually complicated due to the fact that the bottle or beverage container becomes slippery when wet and the bottle or beverage container labels typically fall off or begin to disintegrate into the ice bin area when left for any length of time, no matter how brief. When the labels come off in a residential ice maker bin or commercial ice bin, the end result is that particles of the label sink to the bottom of the bin and clog the ice maker or ice bin drainage line, thus resulting in a water removal problem since the water from melting ice stays in the ice bin and ultimately overflows onto the floor or some other area. A plumber must then be called to unclog the drainage line and any damage to the floor or cabinet area must be repaired.

Another problem is that the bottles or beverage containers typically sink to the bottom of the ice bins and must then be located and retrieved in the sanitized ice either by someone's hand or by some other instrument. When placing bottles or beverage containers in an ice bin for commercial purposes, such as a bar or restaurant situation, the bottles or beverage containers are placed in the ice bin that also provides ice for the drinks by its patrons. This situation provides the opportunity for a bottle or beverage container to get broken in the ice bin when another bottle or beverage container is slammed into the ice after a drink has been poured.

It also provides an extremely unsanitary situation by contaminating the sanitized ice since these bottles or beverage containers are handled by numerous people, are not cleaned off every time they are removed from the ice before being placed back into the ice bin and are typically stored in the same ice bin that provides the ice utilized for patrons drinks. The commercial ice bin in which the bottles and beverage containers are placed or stored is rarely separated from the ice used in the patron glasses.

When most bottles are placed in a residential refrigeration unit after opening, such as wine, the bottle is usually too tall to stand upright in the refrigerator once the cork has been replaced in the bottle after opening. The bottle is usually laid on its side in the refrigerator, resulting in the bottle dripping liquid on the shelves of the refrigerator due to a poor seal from the cork being reinserted into the open bottle.

This cylindrical receptacle provides a convenient, sanitary, organized, effective method, whether for residential or commercial use, for the complete or partial storage or placement of a beverage container(s) or bottle(s) that is best when served cold or chilled.

SUMMARY OF THE INVENTION

It is an objective of the invention to provide a sanitary and effective means to place or store beverage containers and bottles in ice makers, ice bins or in refrigerated units.

It is also an objective of the invention to provide a receptacle that will cool or chill beverage containers or bottles in an organized fashion while aiding in the elimination of breakage or spilled liquids.

It is another objective of the invention to provide an inexpensive chilling or storing receptacle to be utilized in an ice bin for beverage containers or bottles.

The foregoing and other objectives of the invention are achieved by placement or storage of beverage containers or bottles into a cylindrical receptacle with small slots or openings adapted to receive and surround said containers or bottles; an adjustable, permanent support stand that enables the receptacle to be placed in a secure, variable slanted position; and the ability to securely cluster or suspend multiple receptacles, without the support stands, for more typical commercial usage.

BRIEF DESCRIPTION OF THE DRAWINGS

FIG. 1 is a perspective side-view of the chilling and/or storing receptacle for bottles or beverage containers in a slanted position.

FIG. 2 is a perspective view of the receptacle illustrating the minimum and maximum adjustable positions.

FIG. 3 is a perspective view of the suspension clip.

FIG. 4 is a perspective view of the receptacle in a vertical position without the permanent support stand.

FIGS. 5 and 5A is a perspective view of the receptacle connector clamp and a top view of two receptacles clamped together.

FIGS. 6 and 6A is a perspective view of the specially designed rubber receptacle lid or cap.

DETAILED DESCRIPTION OF THE INVENTION

The illustrations show a single and multiple bottle or beverage container receptacle according to a preferred design for this invention. Although the illustrated embodiment of the invention is designed for holding a 0.750–1.00 liter bottle or beverage container, the receptacle may be designed to hold other types and sizes of beverage containers and bottles by suitable alteration of the shape and dimensions of the receptacle.

The receptacle 10 is of cylindrical shape and is dimensioned to receive a typical bottle or beverage container such that the upper end of the bottle or beverage container projects out of the open end of the receptacle. Thus the diameter of the cylinder will be approximately equal to or slightly larger than the typical wine or liquor bottle and the length of the cylinder will be slightly less than that of the average wine or liquor bottle. It will be understood that the cylinder could easily be shaped and dimensioned to receive other types and sizes of bottles or beverage containers.

The cylindrical body of the receptacle is approximately 23.3 cm. in height with the diameter of the opening being approximately 11.11 cm. The receptacle is made of a solid material and is approximately 0.07 cm. thick. This material can vary from plastic to plated base metal to stainless steel. Other dimensions or materials may be provided or utilized to best accommodate the various products that can benefit from the purposes of this receptacle.

The cylindrical body of the receptacle has spaced longitudinal slots or openings 11 approximately 1.0 cm. in diameter around its periphery, which extend along the length and on the closed end 12 of the receptacle. Other shapes or openings may be provided or utilized to provide communication between the cylindrical receptacle and ice or the refrigeration unit. The slots or openings are small enough to prevent ice cubes from entering the receptacle. The rim 13 of the open end of the cylinder is rounded and smooth. When required, the pliably designed rubber receptacle lid or cap 18 approximately 11.18 cm. in diameter, approximately 0.15 cm. thick and has eight equally cut slits 19 with each slit approximately 6.45 cm. in length, easily snaps over the open end of the receptacle.

The adjustable, permanent support stand 14 that is approximately 7.6 cm. wide, has rubber footings 15 and is positioned by loosening two wing nuts 16 on the adjustable support stand. The stand will lock into place in varying positions depending on the point that the two wing nuts are retightened. The area of the cylinder opening closest to the surface supporting the receptacle is approximately 14.6 cm. from that surface when placed in the maximum slanted position.

The receptacles can be clustered together by utilizing a receptacle connector clamp 17 that is approximately 0.15 cm. thick, approximately 0.71 cm. wide and each side of the clamp is approximately 2.54 cm. in length. The connector clamp is pressed over the cylinder rim of two or more of the receptacles thus securing and stabilizing the multiple receptacles. When utilizing the receptacle without a support stand 21 in a commercial ice bin, the receptacle may be suspended in the ice bin by utilizing a receptacle suspension clip 20. This receptacle suspension clip is approximately 0.25 cm. thick. The short end of the clip, approximately 0.6 cm. in length, inserts into one of the openings along the top or open end of the receptacle, while the long end of the clip, approximately 5.0 cm. in length, hangs on the outside wall of the commercial ice bin. The width distance between the short end of the clip and the long end of the clip is approximately 1.27 cm.

While a preferred embodiment of the invention has been described for purposes of illustrations, it will be understood that various changes and substitutions may be made by those skilled in the art without departing from the scope of the invention which is defined solely by the following claims.

What is claimed is:

1. A cylinder shaped receptacle with one open end to receive bottles or beverage containers and is utilized in an ice bin, ice maker, freezer, or any refrigerated placement area to chill, refrigerate or store open, partially used or unused bottles, such as wine or liquor, or any other beverage container that is best when served cold or should be preserved cold, wherein the receptacle is made of any of a number of solid materials and the cylindrical body of the receptacle has small spaced longitudinal slots or openings around its periphery which extend the length of the receptacle and on the closed end of the receptacle.

2. A receptacle as in claim 1 that can be utilized in a vertical, horizontal or slanted position.

3. A receptacle as in claim 1 that is approximately 23.3 cm. in height, 11.11 cm. in diameter, and has a 7.6 cm. wide adjustable, permanent support stand that when the cylinder is in a slanted position places the open area of the cylinder approximately 14.6 cm. from the surface supporting the receptacle.

4. A receptacle as in claim 1 that can be clustered together by a receptacle connector clamp or without the permanent support stand can be suspended in an ice bin by utilizing a receptacle suspension clip.

5. A beverage container, comprising:

a cylindrical shaped receptacle with one open end adapted to receive a beverage container, said receptacle having a perforated wall; and support means coupled to said cylindrical shaped receptacle for supporting said receptacle in a slanted position.

6. The beverage container as specified in claim 5 wherein said support means comprises a support stand.

7. The beverage container as specified in claim 5 wherein said support stand is securingly adjustable to support said receptacle at an angle between 0 and 90 degrees.

8. The beverage container as specified in claim 7 wherein said receptacle has a closed end.

9. The beverage container as specified in claim 8 wherein said closed end is also perforated.

10. The beverage container as specified in claim 7 wherein said support stand further comprises rubber footings tending to restrict said support stand from sliding.

11. The beverage container as specified in claim 7 further comprising securing means for securing said beverage container to second similar said beverage container.

12. The beverage container as specified in claim 11 wherein said securing means comprises a connector clamp.

13. The beverage container as specified in claim 12 wherein said connector clamp is adapted to secure the open ends of two or more said beverage containers together.

14. The beverage container as specified in claim 5 wherein said receptacle is adapted to receive a wine bottle.

* * * * *